US007222677B2

(12) United States Patent
Webre et al.

(10) Patent No.: US 7,222,677 B2
(45) **Date of Patent: *May 29, 2007**

(54) CONTROL LINE GUIDE AND METHOD OF USING SAME

(75) Inventors: Charles M. Webre, Lafayette, LA (US); Brian D. Begnaud, Youngsville, LA (US); Scott J. Arceneaux, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 175 days.

This patent is subject to a terminal disclaimer.

(21) Appl. No.: 10/995,905

(22) Filed: Nov. 24, 2004

(65) Prior Publication Data

US 2005/0161230 A1 Jul. 28, 2005

Related U.S. Application Data

(63) Continuation-in-part of application No. 10/315,617, filed on Dec. 10, 2002, now Pat. No. 6,920,931.

(51) Int. Cl.
*E21B 19/22* (2006.01)

(52) U.S. Cl. ..... 166/379; 166/77.1

(58) Field of Classification Search ..... 166/379, 166/380, 77.1, 77.4, 77.51, 77.52
See application file for complete search history.

(56) References Cited

U.S. PATENT DOCUMENTS 4,523,645 A * 6/1985 Moore ..... 166/385
5,791,410 A * 8/1998 Castille et al. ..... 166/77.1
5,909,768 A * 6/1999 Castille et al. ..... 166/77.1
6,920,931 B1 * 7/2005 Webre et al. ..... 166/379
2004/0079533 A1 * 4/2004 Buytaert et al. ..... 166/380
2005/0161225 A1 * 7/2005 Cole et al. ..... 166/379

* cited by examiner

*Primary Examiner*—William Neuder
(74) *Attorney, Agent, or Firm*—The Matthews Firm

(57) ABSTRACT

A control line guide and manipulating arm can protect and guide one or more control lines which are desired to be attached and lowered into a wellbore with a tubular string. The control lines may be moved toward a tubular string, can be clamped to the tubular string, and the tubular string and control lines may be lowered into the wellbore. When the elevator reaches a predetermined position, the spider slips are preferably set. To protect the control lines, the control lines are moved in a substantially radial direction outward from the tubular string. The spider slips are closed only after the control lines are retained outward. After another tubular joint is connected to the tubular string and the elevator grips the tubular string, the spider slips are preferably released. For easier attachment, of the control lines to the tubular string, the control lines are moved in a substantially radial direction toward the tubular string. As the tubular string and the control lines are lowered into the wellbore, the manipulator arm may again begin retracting to move the control lines away from the approaching elevator as well as to move the control lines out of the way of the movement of the spider slips. The control line guide, which preferably passes through the spider, protects the control lines from the spider slips by allowing the control lines to remain outside the path of the spider slips as they open and close.

6 Claims, 11 Drawing Sheets

CONTROL LINE GUIDE AND METHOD OF USING SAME

RELATED APPLICATION

This application is a continuation in part of U.S. patent application Ser. No. 10/315,617 having a filing date of Dec. 10, 2002 now U.S. Pat. No. 6,920,931 and is related to U.S. patent application titled Control Line Manipulating Arm and Method of Using Same, Ser. No. 10/995,907 having a filing date of Nov. 24, 2004.

TECHNICAL FIELD

This invention relates generally to running control lines and tubular strings into wellbores. More specifically, the present invention relates to protecting and manipulating control lines as they are attached to and inserted into wellbores with tubular strings.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers.

DETAILED DESCRIPTION OF EMBODIMENTS OF THE INVENTION

It is well known in drilling operations, including in the use of oilfield tubulars, that the tubulars are normally added one tubular at a time. Together, these tubulars are typically referred to as a tubular string. The tubulars are normally lifted and manipulated by an elevator which raises and lowers the tubulars and/or the tubular string. This operation further typically utilizes a spider which may be located on the rig floor, beneath the rig floor, or flush with the rig floor for holding the tubular string in place. Above the spider, normal operations may include various sets of tongs and/or other devices for manipulating the tubulars or the tubular string. The spider may include several different sets of slips for gripping the tubular or the tubular string and holding it in place.

Control lines may be operable downhole, on the rig floor, or in other areas. They are typically used to manipulate or operate control devices. Such lines may be encased in coiled tubing or other protective enclosures. They may include pressure hoses or any other type of lines or conduits. Such control lines may carry electrical signals, hydraulic and/or pneumatic fluids, chemicals or even gases, and are normally attached to the tubular strings and lowered into the wellbore by normally feeding the control line from a reel or other source. The control lines may be fed to the drilling rig through a sheave, a roller, or other guiding device which contacts the control lines above the spider.

Figure 1:
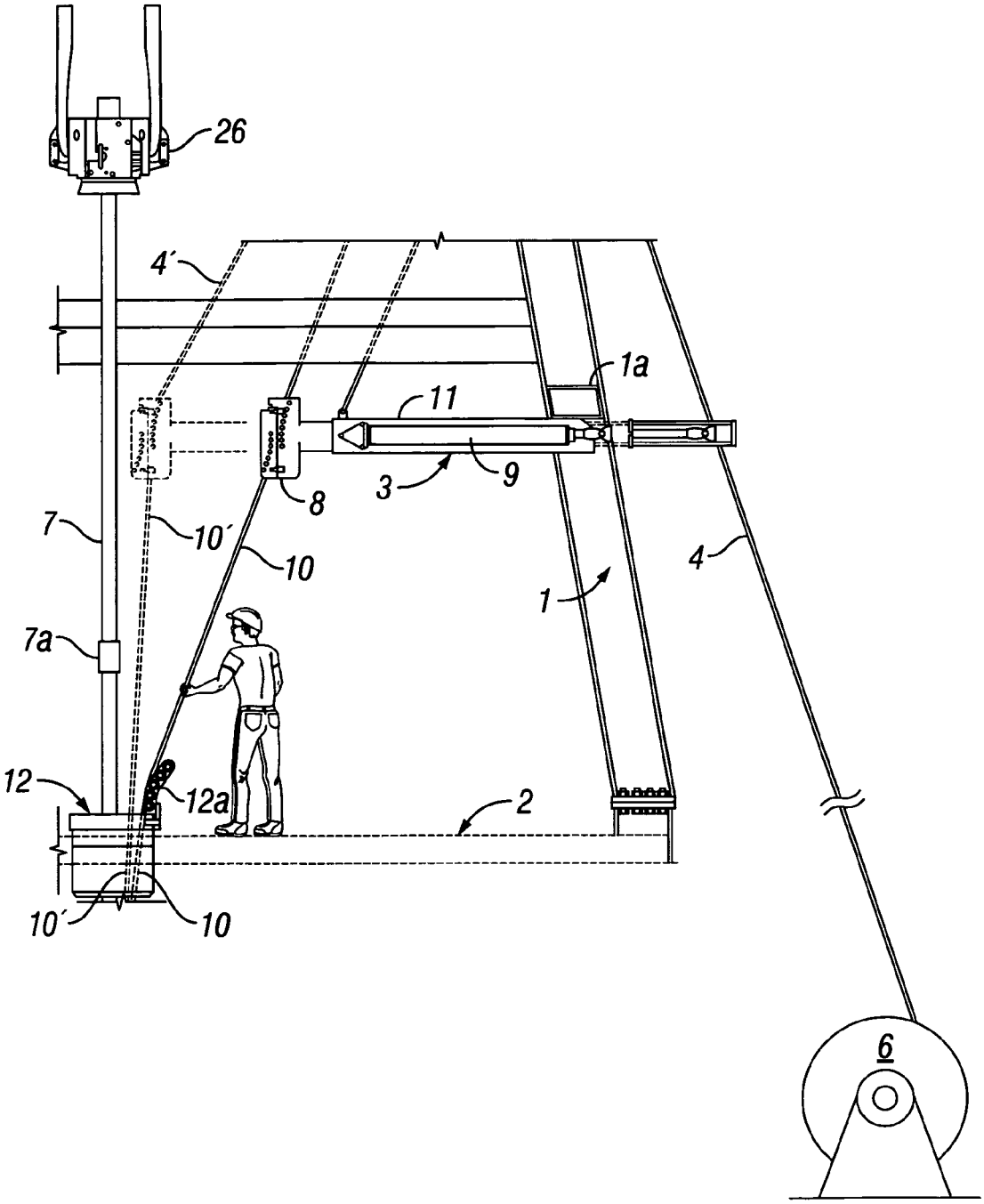
FIG. 1 illustrates a side elevated view of an embodiment of a control line manipulator according to the present invention.
Figure 1A:
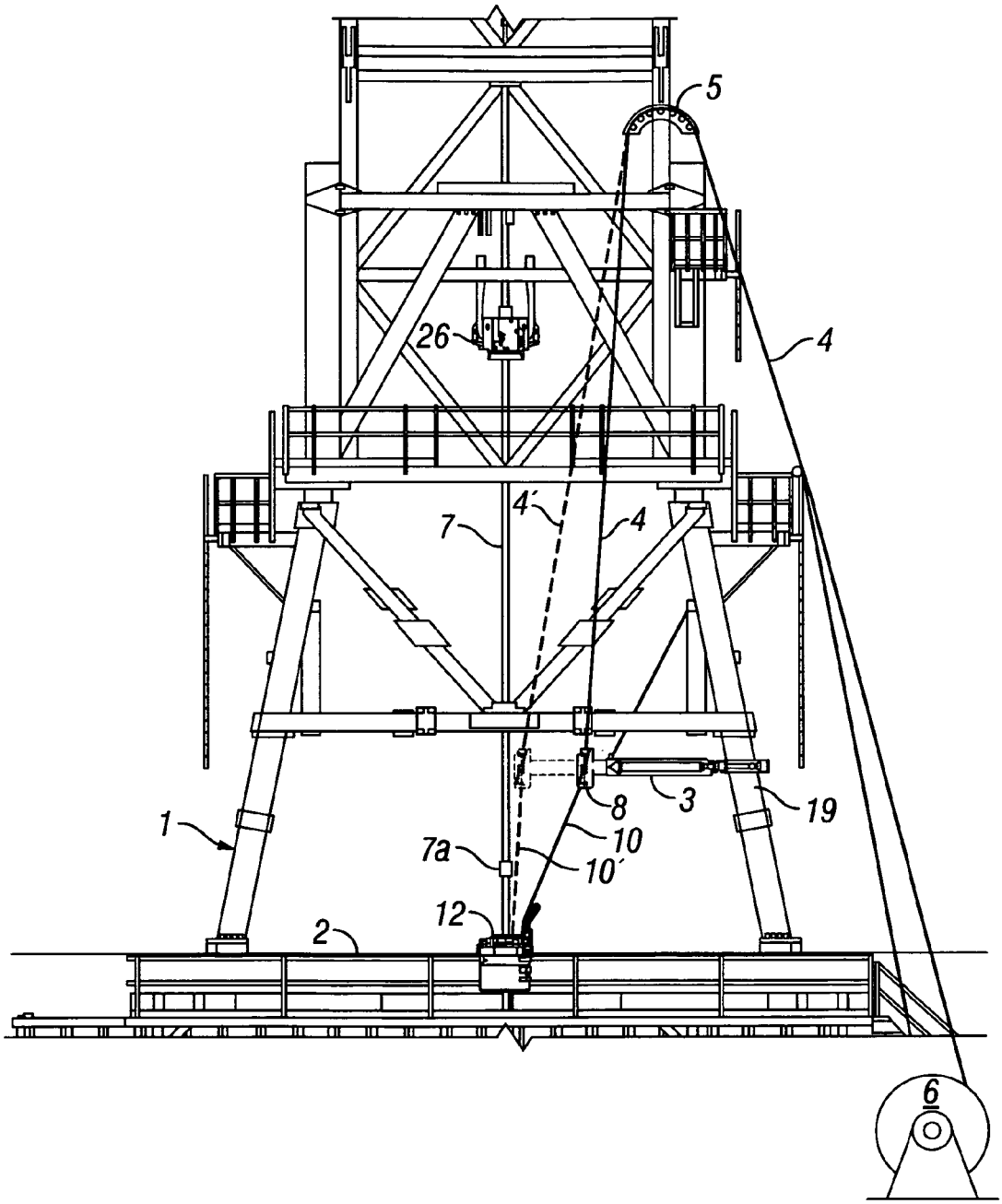
FIG. 1A illustrates an expanded side, elevated view of the control line manipulator according to FIG. 1, showing more of the derrick and the control line path.

FIGS. 1 and 1A illustrate the relationships between the tubular string 7, the control line 4, a control line manipulating arm 3, according to the present invention, and the derrick 1. In this embodiment, one or more control lines 4 are fed to the derrick from a control line reel or other source 6 and typically pass through a control line sheave 5, which may be positioned and attached to the rig high enough above the rig floor so as not to interfere with any other rig operations. It should be appreciated that the control line 4 may be a plurality of control lines. For convenience and clarity, the control line 4 will be described herein below in a singular form, but such description should not be viewed as limiting, since a plurality of control lines 4 is well within the scope of the invention described herein. It should further be appreciated, by those in the art, that as the control line 4 is manipulated by the manipulator arm 3, the control line 4 shall follow different paths. For the purposes of clarity, when the manipulator arm 3 is in a retracted position, control line 4 will follow the path designated by the numeral 10. When the manipulator arm is in the extended position, such that the control line 4 is positioned near the tubular string 7, the path followed by the control line 4 is designated as 10'. For further clarity, control line 4 will be designated as 4' when following path 10'. Typically, tubular string 7 is manipulated by elevator 26, which raises and lowers tubular string 7 into and out of the wellbore through the use of a traveling block and associated hook, well known in the art.

FIG. 1 further illustrates a spider 12, which may be a conventional spider that is mounted below the rig floor 2 or flush mounted with the rig floor 2 or may be any other gripping device which can hold the tubular string 7 in place. Preferably, after a new section of tubular has been connected to tubular string 7 via connector or collar 7*a*, the manipulator arm 3 is extended, preferably by a telescoping action, and pushes control line 4 into path 10'. Preferably, manipulator arm 3 will extend far enough that control line 4' in path 10' is positioned very close to the tubular string 7. Preferably, the control line 4' will be attached by a clamp 18 or other device to the tubular string 7. Such attachment of the control line 4' to the tubular string 7 may preferably be above spider 12 or may be below spider 12. After the control line 4' has been attached to the tubular string 7, elevator 26 will then begin lowering tubular string 7 into the wellbore, along with the attached control line 4'. As the elevator 26 continues its descent, the manipulator arm 3 will begin retracting and will move control line 4' into the position of control line 4 and following path 10. Thus, by the time the elevator 26 reaches a position near the rig floor 2, the manipulator arm 3 will preferably have retracted and will have moved control line 4 out of the path of elevator 26, thus preventing any contact and damage to the control line 4 by elevator 26. FIG. 1 also illustrates an optional guide 12*a*. Optional guide 12*a* is preferably mounted onto spider 12 and may comprise a set of rollers or may be another type of smooth surface which allows sliding contact between the control line 4 and the guide 12*a*. Preferably, the optional guide 12*a* provides a smooth transition for control line 4 as it passes through spider 12.

The manipulator arm 3 is preferably mounted on the beam 1*a* on the derrick 1. Preferably, the manipulator arm 3 is mounted at a convenient height such as to allow personnel to conduct work below the manipulator arm 3. Preferably, the manipulator arm 3 is detachably mounted to the derrick in a conventional manner. It should be appreciated that the mounting of the manipulator arm 3 can also include swivel connections which would allow the arm to be moved or folded out of the way when not in use. It should be further appreciated that when manipulator arm 3 is mounted to the derrick, typically a rig specific mounting bracket may be designed such as to mount the manipulator arm 3 generally in the same plane vertical as the control sheave 5.

Referring still to FIG. 1 for a more detailed view of the manipulator arm 3, the arm 3 preferably comprises a guide head 8, at least one hydraulic cylinder 9, and a telescoping beam 11. The telescoping beam 11 allows the guide head 8 to move the control line 4 in a direction towards the tubular string 7 and away from the tubular string 7 as desired or necessary. It should be understood that the guide head 8 is preferably rigidly attached to the telescoping beam 11. However, in other embodiments, the guide head 8 may be capable of swiveling either hydraulically or as required by the tension of the control lines 4. The stroke length of the telescoping beam is preferably in a range of 48". However, it should be appreciated that the stroke length of the telescoping beam 11 may vary as necessary due to rig design or rig space capabilities. Still further, the stroke length of the telescoping beam 11 should be such that when in the retracted position, the guide head 8 has moved far enough away from the tubular string 7 to avoid any interference with the elevator 26 or any other moving parts of the rig system. When in the extended position, the telescoping beam 11 should position the guide head 8 in close proximity to the tubular string 7. Preferably, hydraulic cylinder 9, which controls the extension and retraction of telescoping beam 11, is hydraulically actuated from a remote console (not shown). However, it should be understood that the control of the hydraulic cylinder 9 may be a variety of means, including pneumatic actuation, hydraulic actuation, electric actuation, any combination of these, as well as any other conventional means. It should be further understood that the hydraulic cylinder 9 may be controlled with a hand-held remote control, as well as the remote console, not illustrated, but which can be located, as desired, on or near the rig floor 2.

It should be appreciated that some rigs or derricks have limited space and may not have room for the mounting of the manipulator arm 3 on a beam such as the beam 1*a*. Another embodiment of the mounting of the manipulator arm 3 would preferably comprise a floor mounted manipulator arm designated as 103, and illustrated in FIGS. 2, 2A, 3, and 3A. The floor mounted arm 103 is preferably pinned to an adapter plate 15 but may also be attached by other conventional methods. The adapter plate 15 may be mounted to the spider 12, such as by attachment pad eyes 16. It should be appreciated that the adapter plate 15 may be mounted to the rig floor 2 or other convenient position. Preferably, this mounting method allows for the manipulator arm 103 to be mounted to a variety of different types of spiders.

Figure 2A:
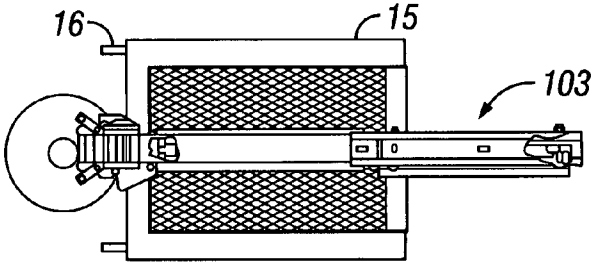
FIG. 2A illustrates the embodiment of FIG. 2 in a different operational position.
Figure 3A:
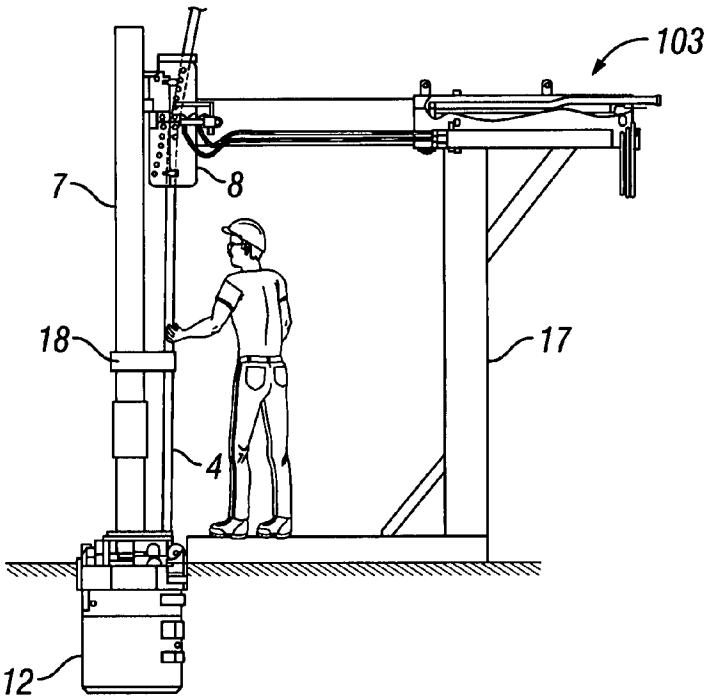
FIG. 3A illustrates a side elevated view of the embodiment illustrated in FIG. 2A according to the present invention.
Figure 2:
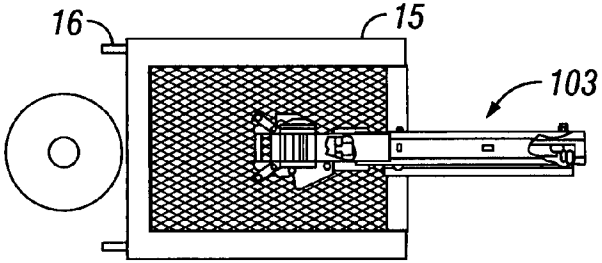
FIG. 2 illustrates a top plan view of a floor mounted embodiment of a control line manipulator according to the present invention.
Figure 3:
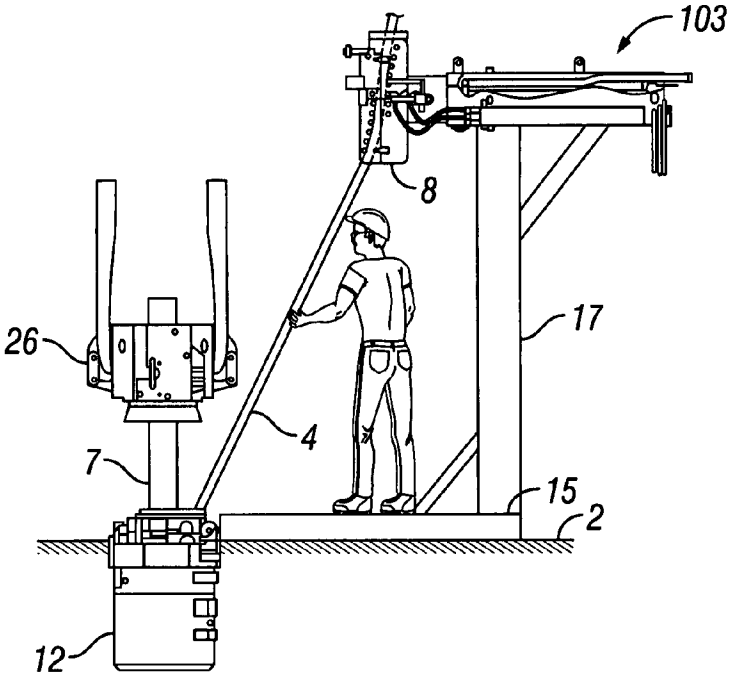
FIG. 3 illustrates a side elevated view of the embodiment illustrated in FIG. 2 according to the present invention.

As further illustrated by FIGS. 2, 2A, 3, and 3A, the manipulator arm 103 is preferably supported by a substantially vertical column 17. Preferably, the manipulator arm 103 mounting includes pin connections such that the manipulator arm 103 could be raised or lowered into a stowed position when not in use, thus, not blocking the limited space in the derrick work area. It should be appreciated that manipulator arm 103 is mounted such as to be in substantially the same vertical plane as the control sheave 5. The vertical column 17 may be attached to the adapter plate 15 in a variety of conventional ways, for example by welding or by the use of conventional fasteners such as threaded nuts and bolts. The attachment is preferably detachable so as to allow relatively easy assembly and disassembly of the structure. The vertical column 17 may also be pivotally mounted to allow the column 17 and the manipulator arm 103 to be tilted further out of the way of rig operations. Further, vertical column 17 may comprise a telescoping assembly to allow for the vertical adjustment of the manipulator arm 103. Still further, vertical column 17 may be mounted so as to swivel or rotate relative to the mounting plate 15. FIG. 3A also illustrates the control line clamp 18 which, as discussed herein above, may be installed above the spider 12, as shown here, or below the spider 12. It should be appreciated that FIGS. 2 and 3 illustrate a top view and side view respectively when the manipulator arm 103 is in the retracted position. Similarly, FIGS. 2A and 3A illustrate top and side views respectively when the manipulator arm 103 is in the extended position.

Figure 4:
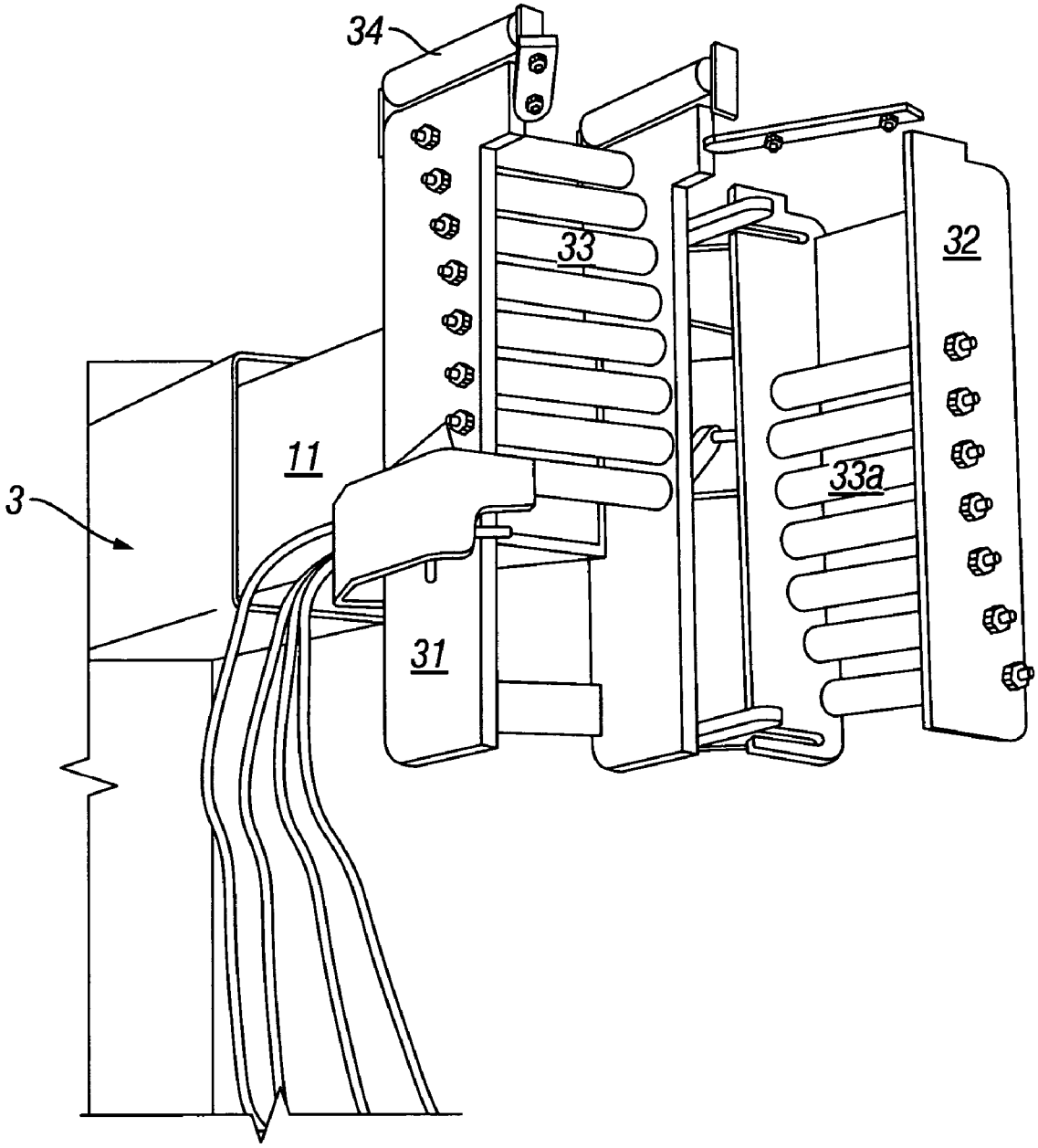
FIG. 4 illustrates an elevated pictorial, isometric view of a guide head of a control line manipulator according to the present invention.

FIG. 4 illustrates an embodiment of the guide head 8. Guide head 8 is preferably attached to the telescoping beam 11 opposite the attachment of the beam 11 to the derrick or attachment to the vertical beam 17. The guide head 8 preferably captures the control line 4 and allows for the manipulation of the control line 4 by the movement of the manipulator arm 3, 103. Preferably, guide head 8 comprises a main body 31, which may be attached to the telescoping beam 11 and a door section 32 which may be pivotally mounted on the body section 31. Preferably, the body section 31 further comprises a set of rollers 33 and the door section 32 further comprises a set of rollers 33*a*. It should be appreciated that the rollers 33, 33*a* can be a variety of type of guides, including smooth surfaces or a variety of number and size of rollers. Preferably, the rollers 33, 33*a* are of a material that does not damage the control line 4. Preferably, control line 4 is inserted into the control head 8 between the body section 31, and the door section 32. With the door section 32 in the closed position, the control line 4 is captured within the guide head 8 and may then be manipulated when the manipulator arm 3 extends or retracts. The rollers 33, 33*a* allow for the control line 4 to easily move through the control head 8 in a substantially unimpeded manner as the manipulator arm 3 is extended or retracted.

Figure 4A:
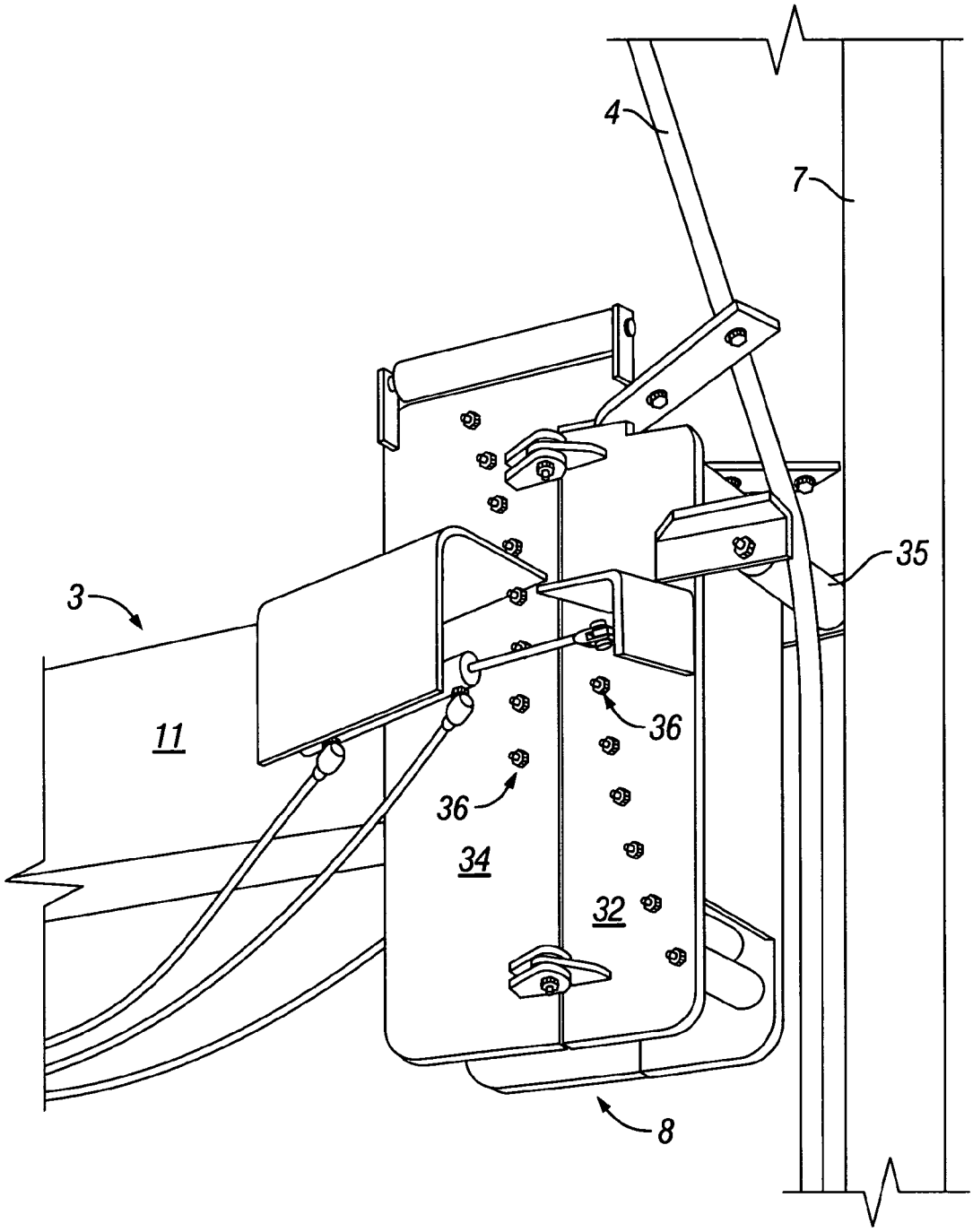
FIG. 4A illustrates an elevated, side view of the guide head of a control line manipulator illustrated in FIG. 4 according to the present invention.

The guide head 8 may comprise other rollers or guides mounted on the outside of the main body 31 or the door section 32. FIG. 4 illustrates such rollers 34 which are mounted on the top of control head 8 and in a direction substantially perpendicular to rollers 33, 33*a*. FIG. 4A illustrates a roller 35 mounted on the outside of door section 32. Rollers 34 provide a guide for control line 4 when such control line 4 is positioned along the inner sides of the guide head 8. The roller 35 may be used for guiding the control line 4 when the control line 4 is not captured inside the guide head 8. Further, roller 35 may also be used as a pipe-stop roller to indicate when the guide head 8 has extended to a position proximate to tubular string 7. It should be appreciated that other rollers, guides or stops may be mounted in a variety of positions in or about the guide head 8. These rollers, guides, or stops will preferably facilitate the operation and functionality of the guide head 8. It should be further understood that although rollers are the preferred method of guidance in the guide head 8, other types of guides can be used to facilitate the efficient and damage-free movement of the control line 4 through or near the guide head 8. It should be understood that although the preferred embodiment of the control head 8 includes the body section 31 and the door section 32. The guide head 8 may be operated in an embodiment containing only the main body 31. In such an embodiment, control line 4 would only be in contact with one set of rollers on the main body section 31. It should still further be appreciated that rollers, such as roller 35, may be used to indicate position or travel limitations. As such, the rollers may further comprise or be replaced by position indication devices, such as but not limited to, limit switches, proximity probes, or other sensors.

The pivotally mounted door section 32 is preferably pneumatically actuated to open and close. It should be understood that the door section 32 can also be actuated in a variety of other ways, including but not limited to, hydraulic, pneumatic, electric, or any combination thereof. The actuation of the door section 32 can also be operated from a remote console or a hand-held remote control. It should be appreciated that the remote console or the hand-held controller may be conventional actuation controllers and are therefore not described in detail herein. Preferably, in operation, the pivotally mounted door section 32 is opened and the control line 4 is placed inside the guide head 8. The pivotally mounted door section 32 can then be actuated to the closed position. After the control line 4 is captured in the guide head 8, the control line 4 will preferably run on the two sets of rollers 33, 33*a* in the body 31 and in the door section 32, respectively. Preferably, the control line 4 will move along one set of the rollers 33 when the manipulator arm 3 is moving the control line 4 in proximity to the tubular string 7 and along the other set of rollers 33*a* when the manipulator arm 3 is retracting. It should be understood that as the manipulator arm 3 moves the control line 4 in proximity to the tubular string 7, the control line 4 is being pushed by the body 31 mounted rollers 33. Likewise, as the manipulator arm 3 retracts or moves the control line 4 in a direction away from the tubular string 7, the control line 4 is being pushed by the door 32 mounted rollers 33*a*. Although some contention may be made that when the manipulator arm 3 is retracting or moving the control line 4 in a direction away from the tubular string 7, the control line 4 is actually being pulled, this is an issue more of semantics and should not be interpreted as limiting the scope of the invention or the appended claims herein. Preferably, the rollers 33, 33*a* or other guide members placed inside the body 31 and/or the door section 32 will constitute a curved profile so as to keep the bend radius of the control line 4 below the maximum bend radius of the control line 4. FIG. 4A further illustrates the curvature 36 of the rollers 33, 33*a*. Preferably, the angle of the control line 4 will depend on the mounting height of the manipulator arm 3 and the mounting height of the control sheave 5 (FIG. 1A).

Figure 5A:
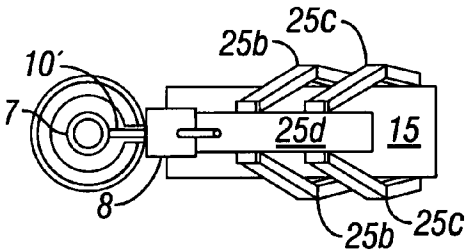
FIG. 5A illustrates the embodiment of FIG. 5 in a different operational position.
Figure 6A:
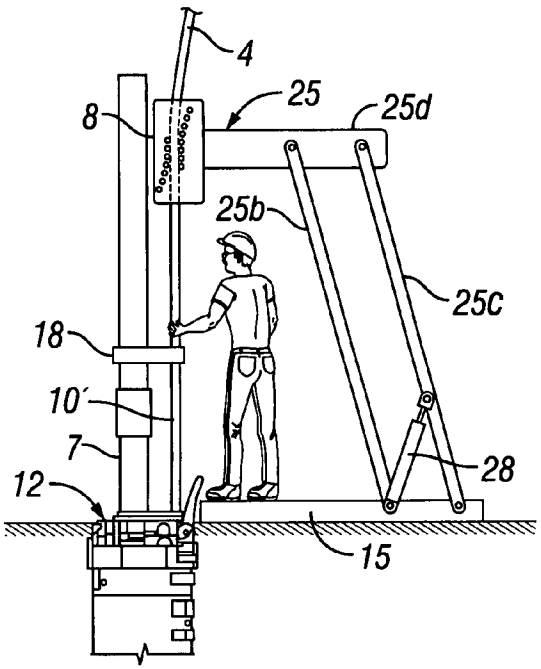
FIG. 6A illustrates an elevated, side view of the embodiment of FIG. SA.
Figure 5:
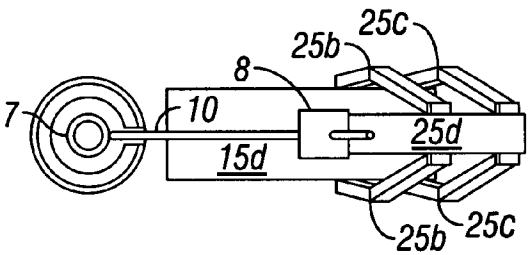
FIG. 5 illustrates a top plan view of an alternative embodiment of a floor mounted embodiment of a control line manipulator according to the present invention.
Figure 6:
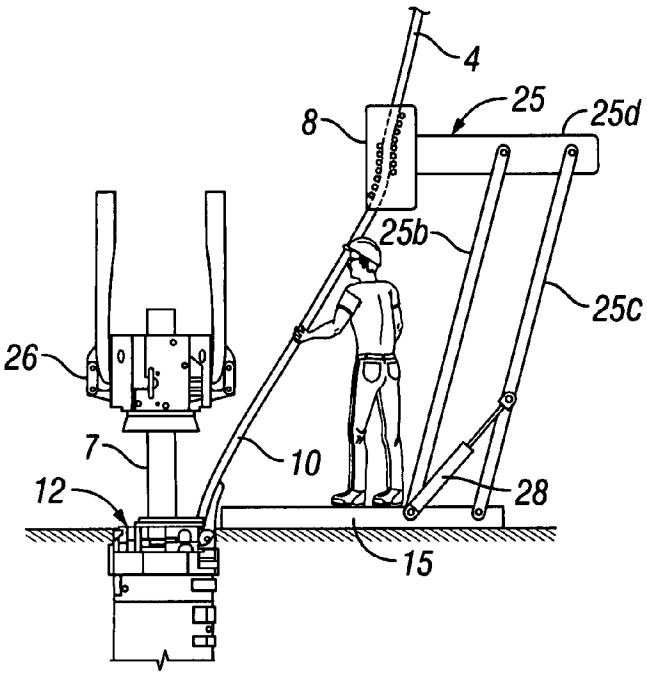
FIG. 6 illustrates an elevated, side view of the embodiment of FIG. 5.

FIGS. 5, 5A, 6, and 6A illustrate an alternate embodiment of the manipulator arm 3 designated here as 25. FIGS. 5 and 6 illustrate a top view and side view, respectively, of the manipulator arm 25 in the retracted position. FIGS. 5A and 6A illustrate a top view and side view, respectively, of the manipulator arm 25 in the extended position. The guide head 8 is preferably attached to beam 25*d* and may move toward and away from the tubular string 7. Beam 25*d* is actuated by cylinder 28 which preferably moves beam 25*c*. The beam 25*b* maintains a substantially parallel relationship between the beam 25*d* and adapter plate 15. It should be appreciated that beam 25*d* may further comprise a telescoping member to provide for greater range of extension and retraction of the guide head 8. Similarly, the substantially parallel beams 25*c* and 25*b* may also comprise telescoping members to allow a greater range of vertical motion for the manipulator arm 25.

Figure 8:
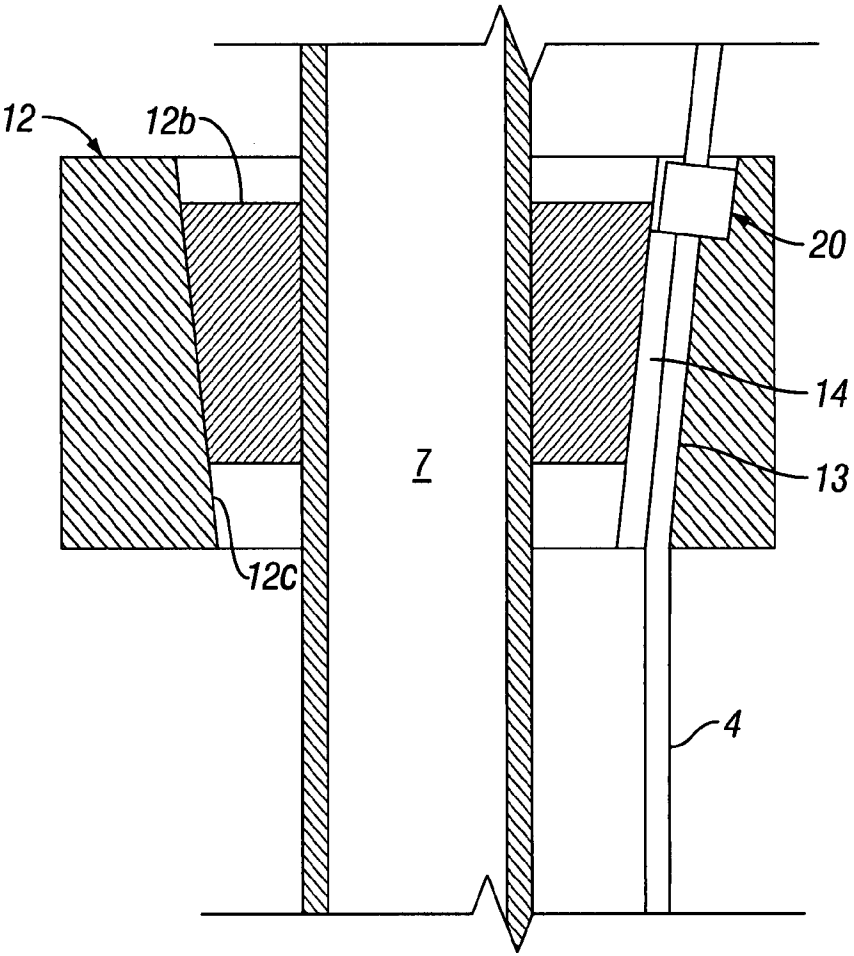
FIG. 8 illustrates an elevated section of the embodiment of FIG. 7 showing an embodiment of a control line protector and enclosure according to the present invention.
Figure 7:
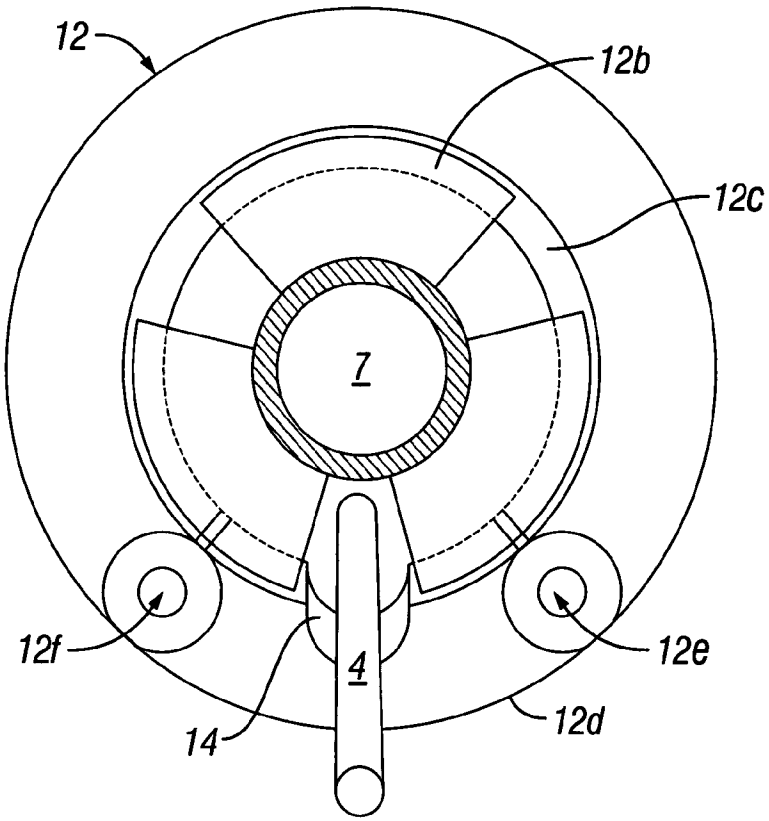
FIG. 7 illustrates a top plan view of a spider configured with a passage for control lines according to the present invention.

FIG. 7 illustrates a top plan view of what is otherwise a conventional spider 12, but which contains a passage 14 for the control line 4. The embodiment of the spider 12 illustrated in FIG. 7 comprises a set of slips 12*b* and a door 12*d*, which may be hinged either by pin 12*e* or pin 12*f*, depending on which-direction the door is to swing. The spider 12 further comprises a set of slips 12*b*, which are shown engaged onto the tubular string 7. Passage 14 is preferably a groove or channel which is cut into the slip door 12*d*. As illustrated in FIG. 8, groove 14 further comprises a substantially curved surface 13, which preferably alters the angle of descent of the control line 4 as it moves through the spider 12 and moves down into the wellbore with the tubular string 7. It should be appreciated that the curved surface 13, in passage 14, is to provide a smoother transition for the control line 4 as it moves through the spider 12. It should also be appreciated that although the passage 14 is shown with as a semi-cylindrical channel, any of several configurations of the passage 14 may be acceptable and should be considered within the scope of this invention. It should be appreciated that the passage 14 may be cut or machined in a substantially vertical direction or in a direction having some pre-determined angle on the inside surface of door 12*d* or of the wall of the spider 12. The passage 14 should be substantially smooth to avoid damage to the control line 4 and allow easy movement of the control line 4 therethrough. If desired, passage 14 can have its own roller, or sets of rollers, to facilitate the movement of the control line 4 through the spider 12. The passage 14 should be configured in a position such that the control line 4 is moveable in a substantially radial direction with respect to the spider 12 and the tubular string 7. It should be appreciated, by those in the art, that spiders may be of various configurations and that not all spiders comprise a door 12*d* or slips of the same configuration as illustrated. It should be further appreciated that regardless of the configuration of the slips 12*b*, the passage 14 is cut such that when the control line 4 is resting in the groove in the passage 14, it does not interfere with the movement of the slips 12*b* as they move from the opened position to the closed position or as they move from the closed position to the opened position. Still further, it should be appreciated that the passage 14 does not have to be cut or machined in the door 12*d* of the spider 12. Passage 14 can be located at any part of the spider 12 such that passage 14 will align with path 10' or path 10 (FIG. 1). In an embodiment with a spider 12 that has no door 12*d*, the passage 14 may be cut or machined into the wall of the spider 12 in a manner substantially similar to that previously described regarding the door 12*d*.

Preferably, passage 14 is configured in such a manner as to contain control line 4 and keep it from moving inadvertently into the path of slips 12*b*. The containment or confinement of the control line 4, within passage 14, may be accomplished by using various latches or catches. These latches or catches may be automatically or manually activated. It should be appreciated that in some embodiments the passage 14 may not require the confinement of the control line 4, and instead rely on the positioning of the control line 4, against the back of the passage 14, to avoid interfering with the spider 12 or the spider slips 12*b*.

An embodiment utilizing a latch or catch is illustrated in FIG. 8. Here, a latch or catch is designated with the numeral 20 and is illustrated within passage 14. The latch 20 may comprise a variety of configurations to secure the control line 4 within the passage 14. The latch 20 may be integral with the spider 12 or may be a separate device mounted within the control line passage 14 and in either case will preferably contain the control line 4 while the control line 4 is passing through the spider 12. It should be understood that the function of the catch and of passage 14 is not to restrict the longitudinal movement of the control line 4 relative to the tubular string 7, but instead to restrict the radial movement of control line 4 such as to prevent the control line 4 from interfering with the opening or closing movement of the spider slips 12*b*.

Figure 9:
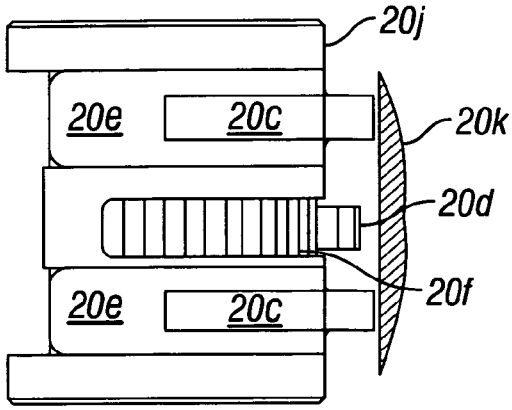
FIG. 9 illustrates a elevated, side view of an embodiment of a control line enclosure configured for a spider according to the present invention.
Figure 10:
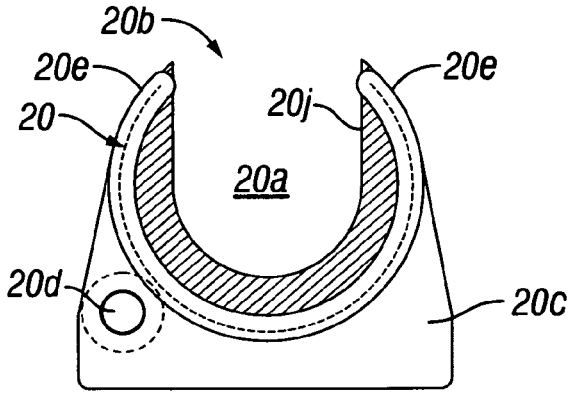
FIG. 10 illustrates a top plan view, partly in cross section, of the device of FIG. 9 in the open position according to the present invention.
Figure 11:
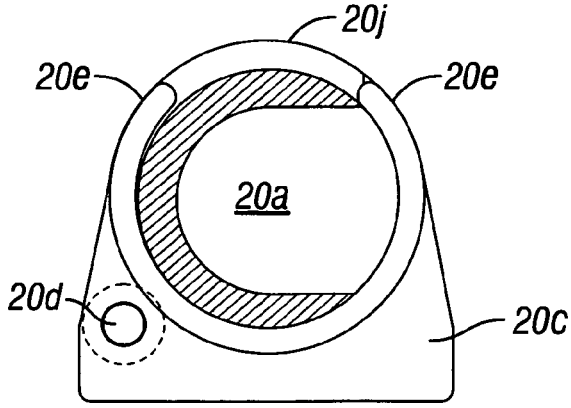
FIG. 11 illustrates the embodiment of FIG. 10 in an enclosing position according to the present invention.

FIGS. 9-11 illustrate one embodiment of the catch 20. In this embodiment, catch 20 comprises a rotatable drum 20*j*, which can be actuated automatically or manually. Preferably, the catch 20 is configured so as to fit within the passage 14. It should be appreciated that the interior passage 20*a* of the catch 20, is in a substantially concentric alignment with passage 14, thus allowing for the passing of the control line 4. When actuated, the rotatable drum 20*j*, rotates such that the catch 20 substantially encloses the control line 4 (FIG. 11). The catch 20 further comprises frame members 20*c* which are preferably attached at one end to a stationary base 20*k* and at the other end to drum support members 20*e*. It should be appreciated that if the catch 20 is mounted or attached to the spider door 12 or the spider wall, drum support members 20*e* may be directly attached to the door or wall thus eliminating the need for the frame members 20*c*. The drum 20*j* is preferably rotated by gear 20*f* which may in turn be actuated by a pinion gear 20*d*. For the automatic rotational operation of the drum 20*j*, the pinion gear 20*d* may be rotated by a motor, gear driver, or other available power source. For manual rotational operation, the pinion gear 20*d* may be rotated by a hand or using a handle, wrench, handwheel, or other manual rotational aid (not illustrated). Further, for manual rotation, a handle, or the like, may be directly adapted to the drum 20*j* thus eliminating the need for both gears 20*d* and 20*f*. FIG. 10 illustrates the open position of the catch 20 wherein the control line 4 may pass through gap 20*b*. It should be understood that the control line 4 will pass through gap 20*b* as the control line 4 moves between path 10 and path 10' (FIGS. 1 and 1A).

Figure 12:
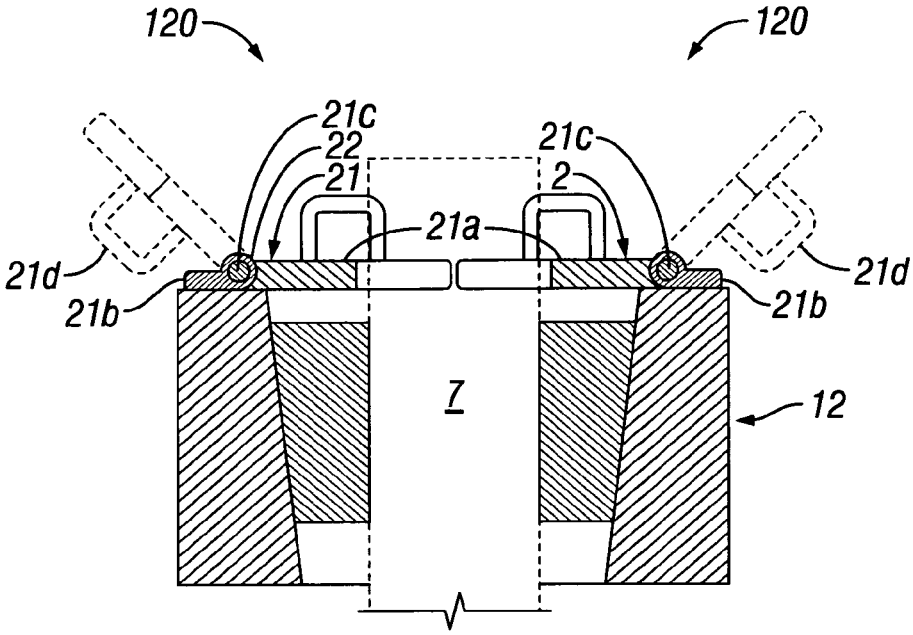
FIG. 12 illustrates a side, sectional view of a flap cover type of protector according to the present invention.
Figure 13:
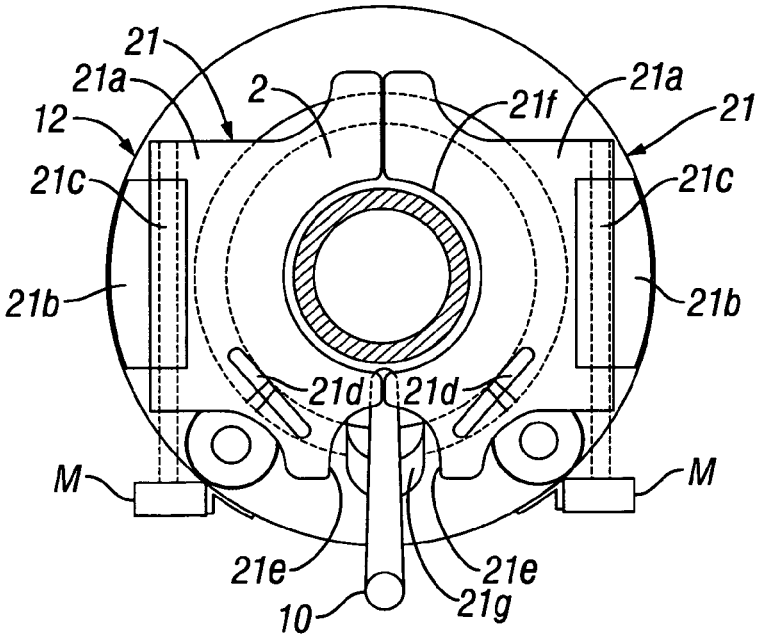
FIG. 13 illustrates a top plan view of the flap cover type of protector according to FIG. 12.

FIGS. 12 and 13 illustrate another embodiment of the catch 120. This embodiment comprises a flapper-type catch. Flapper assemblies 21 are substantially identical and are substantially symmetrically disposed about the throughbore of the spider 12 (the bore through which the tubular string 7 passes). The flaps preferably have openings 21*f* to accept the tubular string 7 and openings 21*e* for confining the control line 4 in a path 10 through the spider 12. Each flapper assembly 21 is preferably attached to the spider 12 by brackets 21*b*. The flappers 21*a* are preferably hinge 22 mounted. It should be appreciated that the flapper assemblies 21 may be mounted in a variety of conventional methods and that the method of mounting or the mounting configuration should not be viewed as a limitation but rather as being fully within the scope of the invention. Further, the type or placement of the hinge as well as other functional manners of attaching the flappers 21*a* should be viewed as being fully within the scope of this invention. For manual operation, of the flapper assemblies 21, handles 21*d* may be attached to the flappers 21*a*. For automatic operation, motors M may be used to rotate the pins 21*c* which are preferably attached to the flapper hinge 22. The motors M are preferably conventional rotary motors and can be actuated through a conventional power means, such as but not limited to, hydraulic, pneumatic, electric, or a combination thereof.

Figure 14:
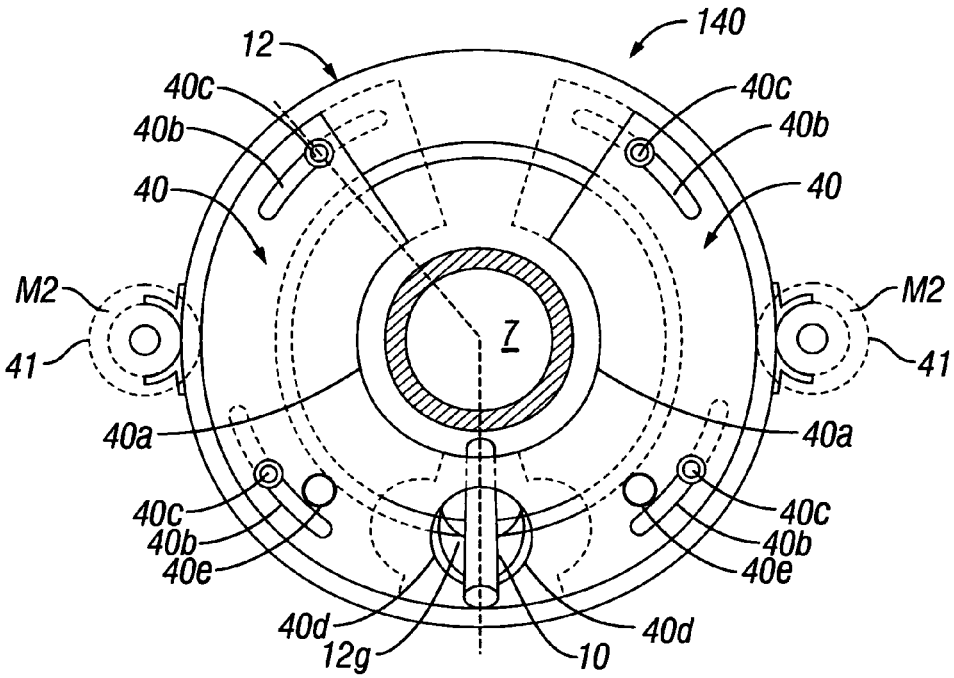
FIG. 14 illustrates a top plan view of a pivoting plate form of control line enclosure according to an alternative embodiment of the present invention.
Figure 15:
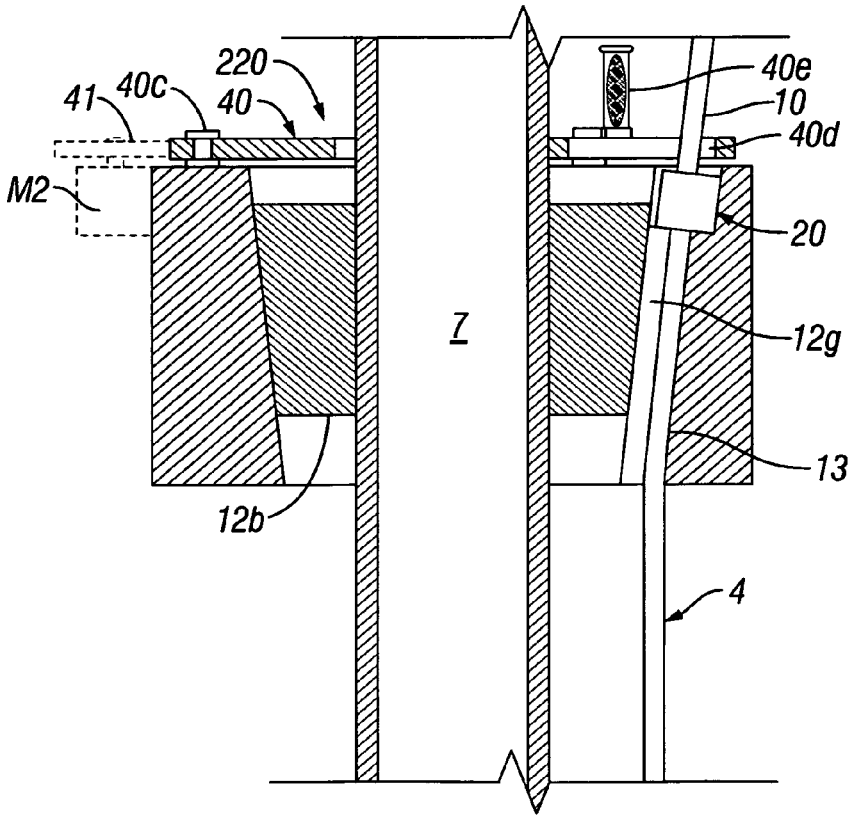
FIG. 15 illustrates a sectional side view of a pivoting plate form of control line enclosure according to FIG. 14.

FIGS. 14 and 15 illustrate another alternate embodiment of the control line catch. The control line catch 220 preferably comprise two substantially identical assemblies 140 which are substantially symmetrically disposed about the throughbore of the spider 12 (the bore through which the tubular string 7 passes). The catch assemblies 140 move substantially along a circumferential path and in a substantially horizontal plane about the through bore of the spider 12 (the bore through which the tubular string 7 passes).

The catch assemblies 140 preferably comprise two catch plates 40 which are attached to the spider 12 by flange bolts 40*c*. The catch plates 40 each preferably comprise slots 40*b* which allow the plates to rotate, in a substantially circumferential direction to confine and release the control line 4. The catch plates 40 further comprise openings 40*a*, to accommodate the tubular string 7, and openings 40*d* to receive and confine the control line 4. It should be understood that the attachment and configuration of the catch assemblies 140 may be easily varied and the description provided herein should not be viewed as limiting as such varied methods of attachment and varied configurations are within the scope of the present invention.

The catch assemblies 140 may be operated either automatically or manually. For manual operation, handles 40*e* are attached, in a conventional manner, to catch plates 40. For the automated operation of the catch assemblies 140, motors M2 may be utilized. Motors M2 are conventional rotation capable motors and are typically powered by rig available power. Motors M2 may comprise a motor driven gear 41, a roller drive, or other motor driven device which can contact and rotate the catch plates 40. It should be appreciated that the motor gear 41 may also be utilized with the manual operation upon the adaptation of a handle, wheel, or similar device capable of rotating gear 41.

FIG. 15 further illustrates the utilization of a second catch 20. It should be appreciated that more than one embodiment of the catch may be used to retain the position of the control line 4 for the purposes of redundancy and/or safety.

It should be understood that the embodiments of the catches and the passage 14 described hereinabove can be retrofitted into existing spiders of various configurations. The installation of such retrofits would preferably be as described hereinabove. Because the methods of retrofitting these embodiments, into existing spiders, would be known to those skilled in the art, after viewing the embodiments described herein, a detailed description of such adaptations will not be described in detail herein. It should be further understood that the embodiments of passage 14 and the various catches described herein are adaptable to other tubular gripping devices which may be used in lieu of conventional spiders or in conjunction with conventional spiders and are fully enveloped in the scope of the instant invention.

A preferred method of operation in utilizing the apparatus to guide and protect the control line 4 may comprise the following steps starting with a tubular string 7 being gripped by the elevator 26 before lowering the tubular string 7 into a wellbore. The control line 4 is moved toward the tubular string 7 (i.e. into path 10') until the control line 4 is in close proximity to the tubular string 7, and the control line 4 is attached to the tubular string by a clamp 18. The tubular string 7 and the attached control line 4 are lowered into the wellbore. The control line 4 is then moved in a direction away from the tubular string 7 (preferably to avoid contact with the now lowering elevator 26)and into passage 14 to avoid any contact between the control line 4 and spider slips 12*b* or other gripping apparatus as the slips or grips move to a closed position to grip the tubular string 7. The spider slip 12*b* or other gripping apparatus is then closed. The elevator slips or grips are opened, thus releasing the tubular string 7 which is preferably supported by the spider 12 or other gripping apparatus. The elevator 26 is moved to its upper position and a new tubular section is added to the tubular string 7. The tubular string load is then transferred to the elevator 26 and the spider slip 12*b* or other gripping apparatus is opened. After this step, the steps repeat with again moving the control line 4 toward the tubular string 7 (i.e. into path 10') until the control line 4 is in close proximity to the tubular string 7. It should be appreciated that this process continues until the tubular string 7 has been extended to a desired depth in the wellbore.

Figure 16:
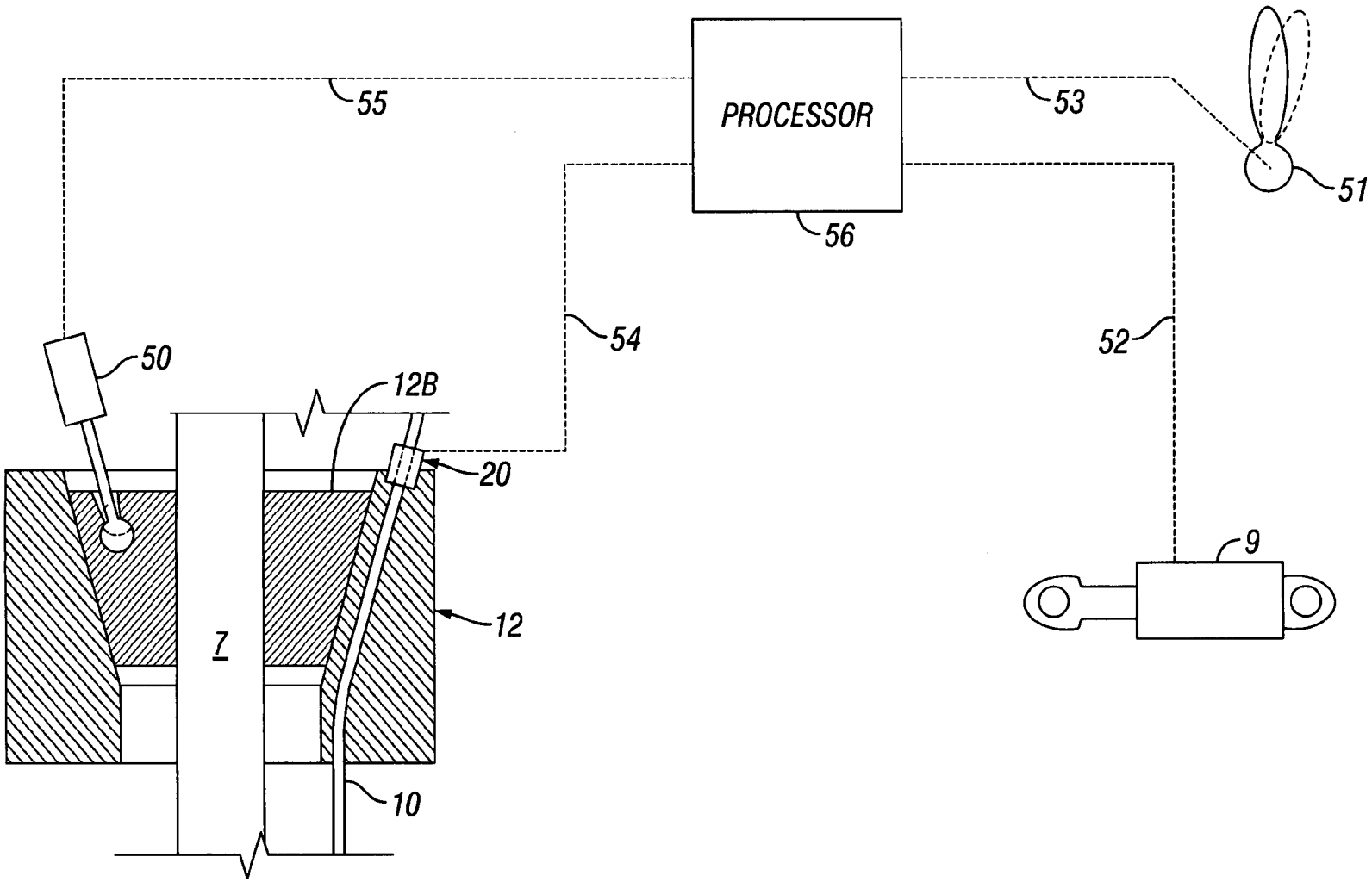
FIG. 16 illustrates a general schematic view for automatic sequencing of the system according to the present invention.

FIG. 16 illustrates a schematic for automatic sequencing control. Lines 52, 53, 54, and 55 conduct signals to and from the processor 56. The signals may include, but are not limited to, actuation commands or position data. The processor 56 preferably responds to the control 51 to actuate the main process functions in the proper sequence, including, but not limited to, actuating the manipulator arm cylinder 9, actuating a catch 20, or actuating the spider slips 50.

In some rig operations, the spider slips 12*b* may be controlled by other sequencing controls. In this case the processor 56 is preferably adapted to prevent interference with any other sequencing controller. Typically, the primary concern is that the spider slips 12*b* must not open when the elevator 26 is not gripping the tubular string 7. Therefore, opening of the spider slips 12*b*, by another sequencer, can be used to sequence the opening of the catch 20. It should be appreciated that the utilization of the catch 20, 120, 140, 220 are optional and not required for every embodiment of the present invention. It should be further appreciated that manual embodiments of the catch 20, 120, 140, 220 would not be responsive to process controllers accept that some embodiments may comprise position indicators of such manual catch 20, 120, 140, 220 when desired. Such position indications are known in the art and thus are not described in detail herein.

It should be further appreciated that when the spider slips 12*b* are controlled independent of the manipulator arm 3, the speed of slip closure may be too fast for the proper retraction and confinement of the control line 4. Therefore, the manipulator arm 3 may begin its retraction at some predetermined position of the tubular string 7 such as when the last added tubular joint is about half way through the spider 12. This operation may also be necessary when the elevator 26 or other rig hardware, associated with the tubular string 7 lowering, is in close proximity to the manipulator arm 3. The closing of the catch 20 or other retention method of the control line 4, if such an embodiment is present, may be started when the manipulator arm 3 has completed its retraction and the control line 4 is now following path 10. The closure of the spider slips 12*b* is sequenced and can only occur once the catches 20, 120, 140 or 220 have captured control line 4.

It is known in the art that the spider slips 12*b* and the elevator 26 may be interconnected and such is more fully described in U.S. Pat. No. 5,791,410 (issued to Castille, et al.), and U.S. Pat. No. 5,909,768 (issued to Castille, et al) both of which are assigned to Frank's Casing Crew and Rental Tools, Inc., the assignee of the instant invention and which are incorporated by reference herein. It should be appreciated that in such a configuration the processor or controller, for the elevator 26/spider12 operation, can preferably be set such that the spider slips 12*b* are actuated only after the control line 4 manipulation has concluded.

It will be understood that certain features and sub-combinations are of utility and may be employed without reference to other features and sub-combinations. This is contemplated by and is within the scope of the claims. It may be seen from the preceding description that a novel control line manipulation and control system has been provided. Although specific examples may have been described and disclosed, the invention of the instant application is considered to comprise and is intended to comprise any equivalent structure and may be constructed in many different ways to function and operate in the general manner as explained hereinbefore. Accordingly, it is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An apparatus for guiding and protecting control lines installed in a wellbore, the control lines passing through at least one tubular gripping apparatus, having at least one tubular engaging surface, for enabling tubulars to be held in place, as desired, and to be moved into and out of the wellbore comprising:

at least one control line which can be secured to a string of oilfield tubulars, and lowered into a wellbore with said oilfield tubulars;

a tubular gripping apparatus comprising:

a first main channel housing one or more sets of slips, providing tubular engaging surfaces, which can open to disengage an oilfield tubular and can close to engage an oilfield tubular, and through which said oilfield tubulars can be moved; and a second guide channel intersecting said first main channel, and through which at least one control line can be moved, wherein said second guide channel retains at least one control line within said second guide channel while said sets of slips are opening or closing to eliminate contact between said slips and said at least one control line.

2. The apparatus according to claim 1, wherein said tubular gripping apparatus comprises a body having said first main channel passing therethrough and having a wall comprising an external surface and an internal surface, wherein said wall at least partially surrounds said first main channel, and said second guide channel is formed in said internal surface of said wall.

3. The apparatus of claim 2, wherein said wall further comprises a door, and wherein said second guide channel is formed in said door.

4. The apparatus according to claim 3, including in addition thereto, the placement of a containment band releasably placed within said second guide channel to releasably maintain said at least one control line within said second guide channel.

5. A method for protecting at least one control line, said at least one control line being attached to a tubular string while said at least one control line and the tubular string are being installed in a wellbore, comprising the steps:

moving the at least one control line to a position proximate the tubular string;

attaching the control line to the tubular string;

lowering the tubular string and the attached control line into the wellbore;

moving a portion of the said at least one control line, above the attachment of the said control line, in a direction away from the tubular string;

releasably securing the control line in a guide within an oilfield spider, wherein the guide slidably retains the control line in a path avoiding contact between said control line and at least one spider slip while said at least one spider slip is opening or closing;

closing said at least one spider slip;

opening at least one slip of an elevator, wherein the elevator slip is in gripping contact with the tubular string when closed, and wherein said opening of the elevator slip releases the gripping contact with the tubular string;

moving the elevator in a substantially vertical direction away from the spider;

connecting a new tubular section to the tubular string;

transferring the tubular string load to an elevator, wherein transferring the load comprises closing said at least one slip of an elevator, thereby positioning the elevator slip in gripping contact with the tubular string;

opening said at least one spider slip; and lowering the tubular string into the wellbore.

6. A tubular gripping, flush mounted spider apparatus having a body and a central bore through said body through which an oilfield tubular may pass while being raised from an earth borehole, or while being lowered into an earth borehole, and having a plurality of slips within said body to grip said oilfield tubular, said apparatus comprising at least one path through said body through which one or more control lines may pass, said at least one path being outside the path being traveled by any of the slips and being configured to prevent any contact between any of the slips and any of the one or more control lines.

* * * * *